United States Patent [19]

Black

[11] 4,125,079

[45] Nov. 14, 1978

[54] PLEATER FOR FORMING COMPARTMENTS FOR A QUILTED FABRIC

[75] Inventor: Robert P. Black, Aughton, England

[73] Assignee: Isothermic Engineering & Research Limited, Ramsey, Isle of Man

[21] Appl. No.: 843,328

[22] Filed: Oct. 18, 1977

[30] Foreign Application Priority Data

Oct. 22, 1976 [GB] United Kingdom ..... 43879/76

[51] Int. Cl.[2] ..... D05B 25/00; D05B 11/00

[52] U.S. Cl. ..... 112/262; 112/155; 112/121.23; 223/28; 112/118; 112/427

[58] Field of Search ..... 112/117, 118, 119, 155; 223/28, 29, 30, 31, 33, 34; 112/120, 144, 145, 405, 427, 432, 262, 121.23

[56] References Cited

U.S. PATENT DOCUMENTS

| | | | |
|---|---|---|---|
| 315,678 | 4/1885 | Turner | 112/405 X |
| 1,402,584 | 1/1922 | Elrod | 223/32 X |
| 1,451,220 | 4/1923 | Heap | 112/145 |
| 1,915,329 | 6/1933 | Mitchell | 112/121.23 |
| 2,074,663 | 3/1937 | Mitchell | 112/262 X |
| 2,132,429 | 10/1938 | Mitchell | 112/121.23 |
| 3,887,118 | 6/1975 | Levenstein | 223/28 |

*Primary Examiner*—Werner H. Schroeder
*Assistant Examiner*—Andrew M. Falik

[57] ABSTRACT

A bag for forming into a quilted article is produced by pleating two sections of material and by feeding pairs of the folded edges thus formed through respective work stations, each pair comprising one edge from each section and the two edges from each pair being fed side by side and simultaneously through the respective station. At each station, the longitudinal edges of a respective strip of flexible material are simultaneously secured to the respective pair of folded edges so as to produce elongate quilting pockets. Apparatus for producing the bag has a plurality of the work stations, means for folding the sections of material, guides which receive the material from the folding means and feed means which co-operate with the guides to feed the folded edges of each pair side by side and simultaneously to the respective work station. The feed means also serve to draw the strips of flexible material from supports for these strips and through the respective work stations. Work means at the work stations are provided to secure the longitudinal edges of each strip simultaneously to the respective pair of folded edges.

16 Claims, 4 Drawing Figures

PLEATER FOR FORMING COMPARTMENTS FOR A QUILTED FABRIC

This invention relates to the production of workpieces, in particular quilted articles.

It is well known to form a continental quilt, duvet or sleeping bag from two layers of fabric interconnected at intermediate intervals to provide quilting pockets which serve to prevent the insulating lining of the quilt from collecting into a single region and thereby reducing the overall efficiency of the quilt.

Initially the two layers of fabric were interconnected merely by lines of stiching but it has been found that this produces "cold spots" along the stitched seams where the insulating lining cannot pad out.

Therefore, the two layers of fabric in known quilts are now generally interconnected in another manner by providing internal walls formed from strips of fabric each stitched along one edge to one layer of fabric and along the other edge to the other layer of fabric. Hitherto, these walls have been sewn to the fabric layers by stitching each individual seam, one at a time, using a manual sewing machine. However, this is a lengthy and consequently costly process.

The present invention seeks, therefore, to facilitate the production of quilted articles, such as continental quilts, as compared with these known processes and at the same time to increase the production rate by securing both edges of each wall simultaneously to the respective layers of material. A further increase in the production rate is sought in a preferred embodiment of the invention by simultaneously stitching a first region of one wall, a second region of a second wall, and so on for the remaining walls, to the fabric layers.

Although the invention is particularly applicable to the stitching of continental quilts, it will be understood that it might have other applications, such as in forming other quilted articles containing elongate pockets.

According to one aspect, the invention comprises forming a method of producing a quilted article, said method including securing at least one strip of flexible material between two sections of flexible material, characterised by forming a respective fold in each section of material, feeding the folded edges of the folds side by side and simultaneously through a work station, and securing the edges of said one strip simultaneously to the folded edges at said work station.

A preferred form of the invention features pleating the sections of material respectively to form a plurality of pairs of corresponding folds, feeding the folded edges of each pair of corresponding folds side by side and simultaneously through a respective work station, and securing the edges of a respective strip of flexible material simultaneously to the folded edges of each pair of corresponding folds at the respective work station.

Conveniently the method includes guiding each pleated section of material along a respective side of a line of work stations, and concurrently feeding the folded edges of the pairs of corresponding folds through successive work stations respectively.

In one embodiment of the invention, the work stations comprise sewing stations where the edges of respective strips of tape are stitched to the folded edges of the pairs of corresponding folds.

Each strip of tape may, advantageously, be fed into the stitching region of the associated station via a respective tape guide which causes the central region of the respective strip of tape to be withheld from the stitching region. This allows the edges of the respective strip of tape to be stitched to the associated folded edges even if the strip is considerably wider than the maximum distance between a respective pair of needles performing the stitching.

The invention also resides in apparatus for producing a quilted article characterised by means for forming at least one pair of corresponding folds in two sections of material, guides arranged to co-operate with a feed device for feeding the folded edges of said one pair or folds side by side and simultaneously to a or a respective work station, and work means adapted to secure the edges of a strip of material simultaneously to the folded edges at said station.

In a preferred embodiment of the invention wherein more than one corresponding pair of folds are formed in the respective sections of material during operation of the apparatus, the guides may comprise co-extensive sets of guide rails arranged to run along respective sides of a line of work stations with a respective pair of guide rails, one from each set, terminating at each work station. Advantageously, each pair of guide rails terminates in a pair of turned-in ears arranged to guide the folded edges of the respective corresponding pair of folds into an operating region of the work station. Alternatively, the guides may, for example, comprise gripper means adapted to engage each fold and to supply the corresponding pairs of folds to respective work or sewing stations.

Preferably the apparatus also has a plurality of tape guiding means for positioning respective strips of tape in each operating region, each tape guiding means comprising a member with a tongue-shaped surface, which surface is located between the turned-in ears of a respective pair of guide rails, and a bridge-like presser member adapted to co-operate with the tongue-shaped surface so as to crimp the tape, in use, as it is operated on.

The feed device may conveniently comprise a pair of rollers adapted to frictionally engage the sections of material, one of the rollers at least being driven from appropriate drive means.

A respective ribbed former which is of fan-like configuration and whose ribs decrease in height as they radiate outwardly can be used to produce one or more folds in each section of material.

The invention is described further, by way of example, with reference to the accompanying drawings, in which.

Figure 1:
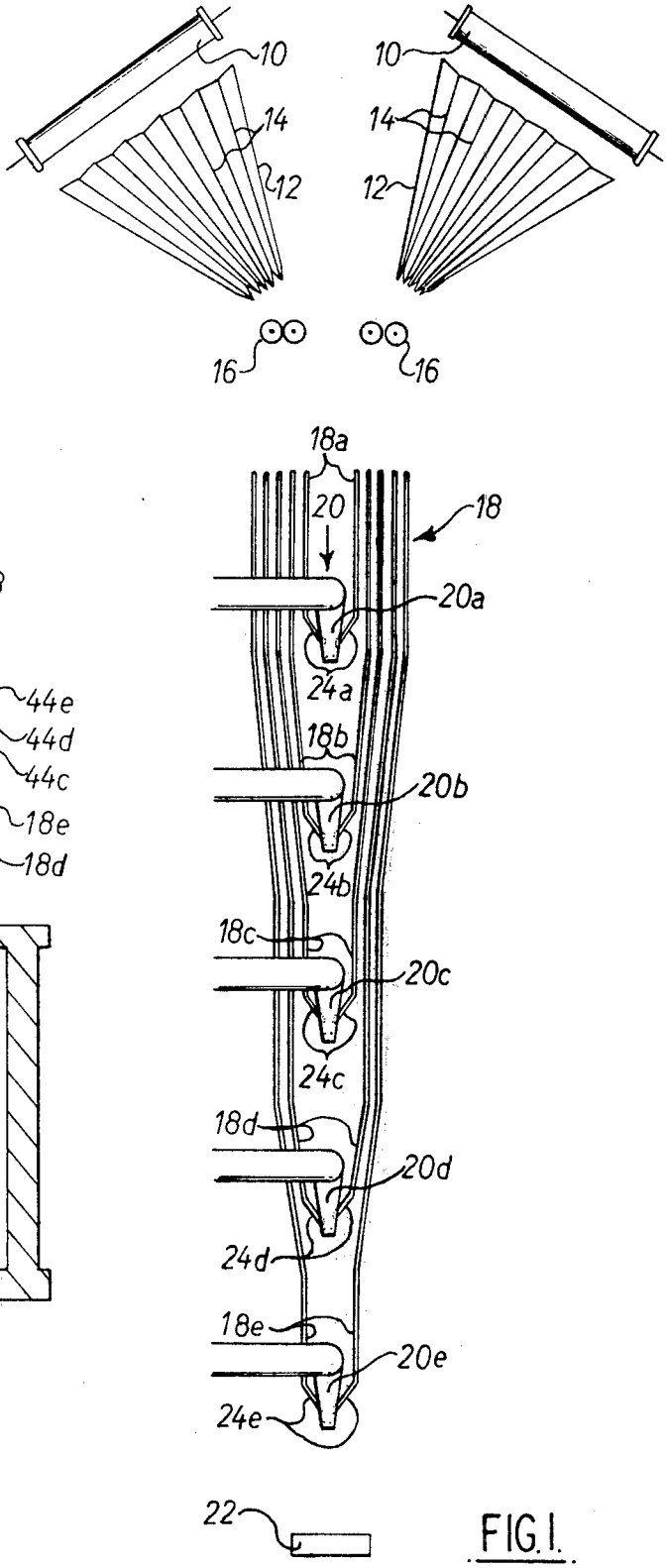
FIG. 1 is a diagrammatic plan view of apparatus, in accordance with the invention, for producing continental quilts.

Referring to FIG. 1, the apparatus comprises a pair of horizontal supports 10 for carrying respective rolls of material, and a pair of ribbed formers 12. These formers are of fan-like configuration with the ribs 14 of each former 12 converging towards each other and increasing in height as they recede from the flared end of the respective former. The flared ends of the two formers 12 are located adjacent to the supports 10 for receiving material therefrom and the tapered ends of the formers are arranged to pass the material to respective pairs of vertical rollers 16 which compress the material, in use, into creased folds. In addition, means not shown are provided for moulding the material to the shape of the respective former as it passes thereover.

At a distance from the pairs of vertical rollers 16, two sets of parallel vertical guide rails 18 commence and extend, away from the rollers 16, past a line of sewing machines 20 on either side thereof. In use, each fold of material is supported on a respective guide rail and so each set of guide rails includes a sufficient number of rails to accommodate the folds of material emerging from one pair of vertical rollers 16. The guide rails are mounted on a table 19 and are arranged in corresponding pairs 18*a* to 18*e*, each pair including one rail from each set and terminating at a respective sewing machine 20. The innermost pair of rails 18*a* terminate at the sewing machine 20*a*, which is situated nearest to the rollers 16 and the outermost pair of rails 18*e* extend as far as the machine 20*e* located furthest from the rollers 16 and terminate there.

Beyond the machine 20*e* there is provided a pair of horizontal feed rollers 22 one of which is driven from a motor (not shown). These feed rollers are adapted to engage the material and draw it along the guide rails past the line of sewing machines in such a manner that the material can be stitched as it is being advanced.

In order to bring a respective pair of corresponding folds of the material into the stitching region of each sewing machine, in use, each pair of guide rails terminates just upstream of the stitching region of the associated machine in a respective pair of in-turned ears 24*a* to 24*e*. Referring to the guide rails 18*a*, the ears 24*a* are formed merely by bending a corner of each rail inwardly towards the machine 20*a*. The other pairs of ears 24*b* to 24*e* are formed in a like manner.

Figure 2:
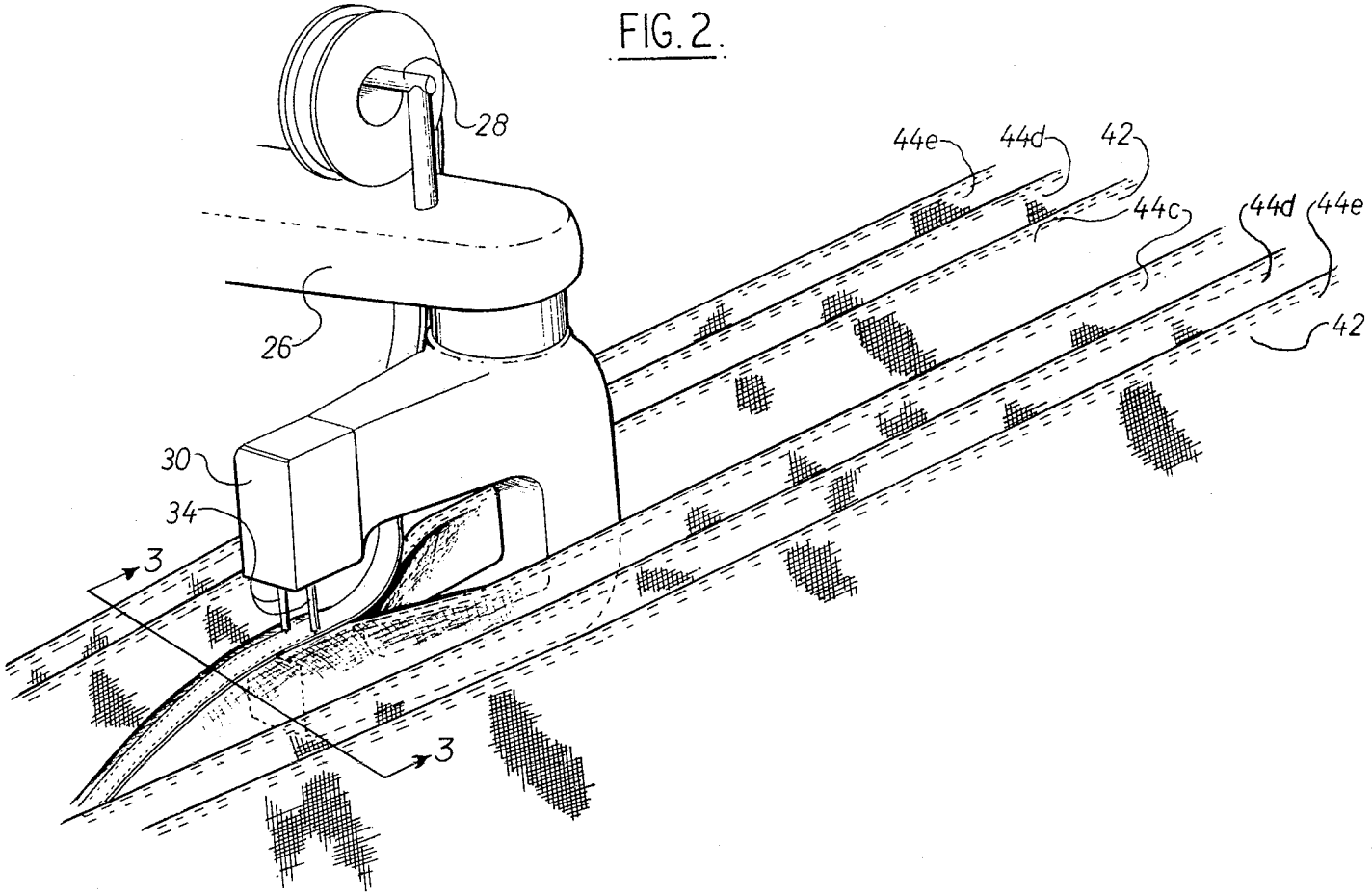
FIG. 2 is a diagrammatic perspective view showing a portion of the apparatus of FIG. 1 in operation.
Figure 4:
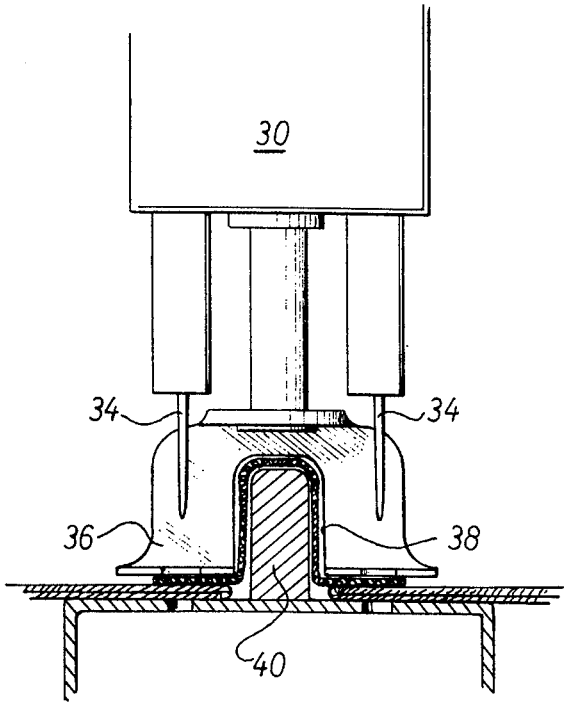
FIG. 4 is a detail of a stitching region of the apparatus.

FIGS. 2 and 4 show one of the machines, which is of the twin needle feed-off-the-arm variety, in greater detail, the other machines being identical with this one machine. This machine is suspended from an overhanging arm 26 carrying a mounting 28 for a reel of tape. The sewing head 30 of the machine is arranged above a support surface 32 for receiving the material being stitched, and a pair of needles 34 for performing the stitching are mounted in the head 30 so that they are located immediately downstream of the associated in-turned ears 24 and so that the spacing between the needles 34 is slightly greater than that between the associated ears 24. In addition, a bridged presser foot 36 depends from the head 30 and is movable from a raised position into the position shown in FIG. 2 wherein it presses the material against the surface 32. The arch 38 of the presser foot is shaped to conform to a ridge 40 mounted on the surface 30 whereby to form a ridge in a strip of tape passing between the ridge 40 and presser foot 36 during sewing.

Operation of the apparatus is as follows:

Two rolls of material are mounted on the supports 10 and a length of material 42 from each roll is drawn by the feed rollers 22 over the associated former, being pressed against the former by the moulding means, not shown, which produce loose folds in the material. These loose folds which are arranged in pairs of corresponding folds are then compressed together to form creased folds or pleats 44 arranged in pairs 44*a* to 44*e* by feeding the lengths of material through the respective pairs of vertical rollers 16.

Figure 3:
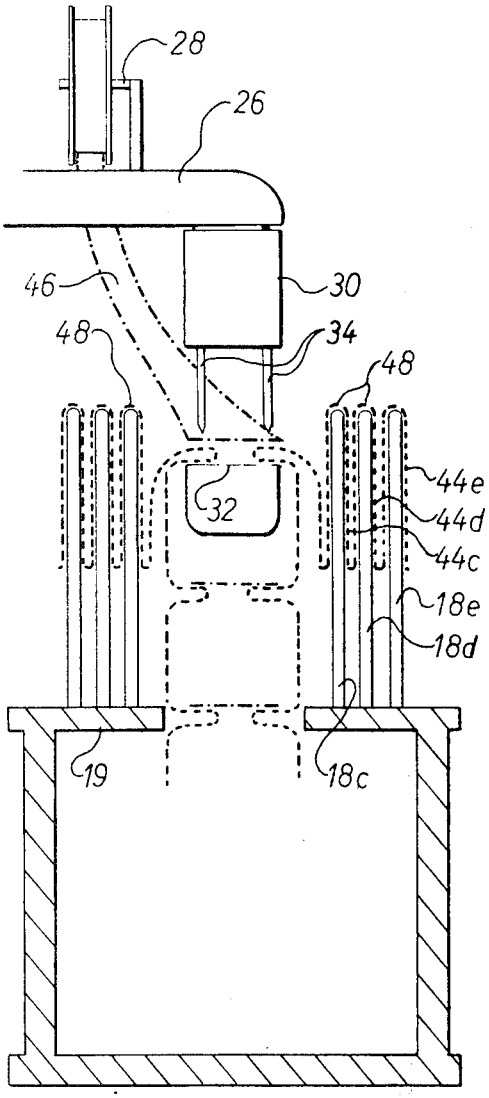
FIG. 3 is a section taken along the line 3-3 in FIG. 2.

From here, each length of material 42 is drawn onto one set of guide rails 18 such that each guide rail supports a respective fold of material as shown in FIG. 3, the creases formed by pressing the folds facilitating guidance of the lengths of material. The two lengths of material are drawn in unison along the rails 18 and at the same time strips of tape 46 are fed to the sewing machines 20 from respective reels of tape carried on the mountings 28.

At the first machine 20*a*, the innermost corresponding pair of folds pass over the inturned ears 24*a*, and the folded edges 48 of the folds are thus turned through 90° from the vertical to the horizontal. Since this takes place just upstream of the twin needles 34 of the machine 20*a* and the tips of the inturned ears are located slightly closer together than are the needles 34, the folded edges pass parallel under the needles as the material is advanced.

The associated strip of tape 46 is unwound from its reel at the same time. The tape, being wider than the spacing between the two needles, is crimped up in the centre by being fed between the ridge 40 and presser foot 36, so that the edges of the tape also pass under the two needles.

As the folded edges and the edges of the tape advance under the needles, they are stitched after which they drop off the surface 30 and pass out of the way under the second and each succeeding machine 20. In a like manner, the folded edges of the next innermost corresponding pair of folds are brought into the stitching region of the machine 20*b* and are stitched to a second strip of tape. These folded edges then travel under the third and each succeeding machine as the material is advanced. Similarly, the remaining folded edges are stitched to associated strips of tape, the folded edges of what is initially the outermost corresponding pair of folds being stitched to the associated strip of tape at the machine 20*e*, so that successive regions of the respective folded edges are being stitched simultaneously.

After leaving the line of machines, the pocketed material passes between the feed rollers 22 and then collects at a gathering station (not shown). From here the material is carried to various other stations such as a filling station and a quilt-sealing station in order to complete the quilt.

It will be seen that the method and apparatus described above serve to automate much of the stitching of quilted articles such as continental quilts.

I claim:

1. A method of producing a bag for forming into quilted article comprising the steps of providing strips of flexible material, feeding said strips through respective work stations, providing two sections of flexible material, folding the material of each of said sections to form folded edges therein, pairing said folded edges of one section with said folded edges of the other section, feeding said folded edges of a respective pair side by side and simultaneously through each of said work stations, securing the longitudinal edges of a respective one of said strips simultaneously to said folded edges of said respective pair at each of said work stations, and forming thereby elongate quilting pockets with open ends.

2. A method according to claim 1 further comprising the steps of guiding said sections of material, when folded, along respective sides of a line of said work stations, and feeding said folded edges of said pairs through successive work stations respectively.

3. A method according to claim 2 further comprising the step of passing said folded edges of each pair beneath successive work stations after feeding said folded edges through the respective work station.

4. A method according to claim 2 wherein said sections of material are guided along respective sides of said line of said work stations by guiding said folded edges of said two sections respectively along two converging sets of parallel paths arranged one set on each side of said line in pairs of converging paths, which pairs lie one within the other and terminate respectively at said successive work stations.

5. A method according to claim 4 comprising the step of turning said folded edges of each pair through approximately 90° towards each other upstream of an operating region of the respective work station whereby to bring said edges into said operating region.

6. A method according to claim 1, further comprising the step of crimping the central region of each of said strips of flexible material at the respective work station whilst securing said longitudinal edges to said folded edges of said respective pair.

7. A method according to claim 1 wherein said longitudinal edges are secured to said folded edges by stitching.

8. Apparatus for producing a bag for forming into a quilted article, comprising a plurality of work stations, means for folding two sections of material to form folded edges therein, guides for receiving said material from said folding means and for carrying said material with said folded edges of one section paired with said folded edges of the other section, feed means arranged to co-operate with said guides so as to feed said folded edges of a respective pair side by side and simultaneously to each of said work stations, supports for carrying strips of flexible material, said feed means also being arranged to feed a respective one of said strips to each of said work stations, and work means located at each of said work stations and adapted to secure the longitudinal edges of said respective strip simultaneously to said folded edges of said respective pair.

9. Apparatus according to claim 8 wherein said work stations are disposed in a line having two sides, and wherein said guides comprise two sets of carries arranged on respective sides of said line.

10. Apparatus according to claim 9 wherein said two sets of carriers comprises two converging sets of parallel rails, said rails being arranged in pairs, which each include one rail from each of said sets and which lie one within the other, each of said pairs of rails terminating at a respective one of said work stations.

11. Apparatus according to claim 10 wherein each of said pairs of rails terminates in a pair of turned over ears directed towards said line of work stations.

12. Apparatus according to claim 8 further comprising guide means located at said work stations for guiding said strips of material past said work means and for witholding the central regions of said strips from said work means.

13. Apparatus according to claim 12 wherein each of said guide means comprises a respective support having a tongue shaped surface, and a respective bridge-like presser member arranged to co-operate with said tongue shaped surface.

14. Apparatus according to claim 8 further comprising at least one pair of rollers disposed between said folding means and said guides for pressing creases into said folded edges.

15. Apparatus according to claim 8 wherein said feed means comprise a pair of rollers arranged frictionally to engage said strips of material and said sections of material, and drive means for driving at least one of said rollers.

16. Apparatus according to claim 8 wherein each of said work means comprises a feed-off-the-arm, twin needle, sewing machine.

* * * * *